US008701213B2

(12) United States Patent
Cronan

(10) Patent No.: US 8,701,213 B2
(45) Date of Patent: Apr. 22, 2014

(54) BODY-SHAPING INTIMACY GARMENT

(76) Inventor: Laurie Cronan, Barrington, RI (US)

( * ) Notice: Subject to any disclaimer, the term of this patent is extended or adjusted under 35 U.S.C. 154(b) by 862 days.

(21) Appl. No.: 12/902,354

(22) Filed: Oct. 12, 2010

(65) Prior Publication Data

US 2012/0084898 A1 Apr. 12, 2012

(51) Int. Cl.
*A41B 9/00* (2006.01)

(52) U.S. Cl.
USPC ..... 2/69; 2/78.2; 2/78.3; 450/123

(58) Field of Classification Search
USPC ..... 2/69, 409, 78.1, 78.4, 73; 450/95, 96, 450/100, 102, 103, 105, 116, 122–125
See application file for complete search history.

(56) References Cited

U.S. PATENT DOCUMENTS

| | | | | |
|---|---|---|---|---|
| 3,823,721 | A | 7/1974 | Herbener | |
| 4,627,111 | A * | 12/1986 | Storie | 2/69 |
| 5,729,836 | A | 3/1998 | Ewing | |
| 5,790,984 | A * | 8/1998 | Doubleday | 2/69 |
| 5,930,838 | A * | 8/1999 | Carter-Scott-Pomije | 2/79 |
| 6,276,176 | B1 | 8/2001 | Blakely | |
| 6,463,765 | B2 | 10/2002 | Blakely | |
| 6,517,409 | B2 | 2/2003 | Flaherty | |
| 7,024,892 | B2 | 4/2006 | Blakely | |
| 39,326 | A1 * | 1/2007 | Rothman | 2/69 |
| 7,318,240 | B1 | 1/2008 | Rendone | |
| D589,234 | S | 3/2009 | Blumenfeld | |
| 7,634,818 | B1 * | 12/2009 | Trujillo et al. | 2/48 |
| 7,648,408 | B2 | 1/2010 | Lung | |
| 7,654,115 | B2 | 2/2010 | Duckham et al. | |

(Continued)

FOREIGN PATENT DOCUMENTS

| | | | |
|---|---|---|---|
| DE | 10044202 | A1 | 4/2002 |
| EP | 1166660 | A1 | 1/2002 |

(Continued)

OTHER PUBLICATIONS http://www.pamperedpassions.com/shelf_bra_178_ctg.html; May 27, 2010; 2 pages.

(Continued)

*Primary Examiner* — Clinton T Ostrup
*Assistant Examiner* — Andrew W Sutton
(74) *Attorney, Agent, or Firm* — Fish & Richardson P.C.

(57) ABSTRACT

A body-shaping intimacy garment for a woman has an upper portion that supports or at least contacts undersides of the breasts while leaving the breasts exposed, a torso portion extending from the upper portion, a lower portion that encircles the waist, buttocks and hips while defining a crotch opening through the garment for access during intimate encounters, and leg portions that extend to below the knee. The torso portion, lower portion and leg portions each include respective portions of inner and outer layers of stretchable fabrics. The inner layer fabric is worn stretched about the torso, waist, buttocks, hips and legs, with tension in shoulder straps maintaining some inner layer stretch along the torso portion while worn. The outer layer fabric has a lesser elasticity than the inner layer fabric, and the two fabric layers are connected at the bust but are otherwise disconnected throughout front and sides of the torso and lower portions, and throughout the leg portions to at least below the knee, such that the outer layer is configured to slide over the inner layer, and to flow over local curvature fluctuations of the inner layer, during movement.

20 Claims, 8 Drawing Sheets

(56) References Cited

U.S. PATENT DOCUMENTS

| | | | | |
|---|---|---|---|---|
| 7,694,350 | B2 * | 4/2010 | Hodges et al. | 2/114 |
| 7,712,152 | B2 * | 5/2010 | Adamson | 2/104 |
| 2004/0128733 | A1 | 7/2004 | Hendricks | |
| 2004/0142630 | A1 | 7/2004 | Lambru | |
| 2006/0277648 | A1 * | 12/2006 | Harry | 2/69 |
| 2007/0015439 | A1 * | 1/2007 | Fu | 450/100 |
| 2007/0163026 | A1 * | 7/2007 | Perry | 2/69 |
| 2008/0139086 | A1 * | 6/2008 | Jones | 450/100 |
| 2010/0005560 | A1 * | 1/2010 | Albizre | 2/54 |
| 2010/0125538 | A1 | 5/2010 | Staw et al. | |
| 2012/0084898 | A1 * | 4/2012 | Cronan | 2/69 |

FOREIGN PATENT DOCUMENTS

| | | | |
|---|---|---|---|
| GB | 1306973 | A | 2/1973 |
| WO | WO9621368 | A1 | 7/1996 |
| WO | WO9626700 | A1 | 9/1996 |
| WO | WO0232244 | A1 | 4/2002 |

OTHER PUBLICATIONS http://lordshopping.com/item.asp?pid=91; May 27, 2010, 3 pages.

http://www.bella-jane.com/full_body_18_ctg.htm; Apr. 28, 2010; 2 pages.

http://www.bella-jane.com/body_suit_3018_sb_699_prd1.htm; Apr. 28, 2010; 2 pages.

http://bella-jane.com/body_suit_3016_sb_698_prd1.htm; May 27, 2010; 2 pages.

http://cgi.ebay.com/Underbust-FULL-BODY-SUIT-waist-cincher-SHAPER-MEDIUM; May 27, 2010; 5 pages.

http://cgi.ebay.com/FULL-BODY-thigh-Shaper-waist-cincher-PLUS-SIZE-blk-3XL; May 18, 2010; 3 pages.

http://cgi.ebay.com/NEW-FULL-BODY-SHAPER-Suit-Extra-Firm-Control; May 27, 2010; 16 pages.

* cited by examiner

BODY-SHAPING INTIMACY GARMENT

TECHNICAL FIELD

This invention relates to garments to be worn by women before and during sexual intimacy.

BACKGROUND

Each day women are bombarded with sexy models and celebrities baring bodies, surgically enhanced and retouched to perfection. Magazines, movies, the internet, television and billboards—everywhere a woman looks she is met with a vision of flawlessness. These unattainable images set the highest of standards for women, and may leave them feeling physically inadequate and reluctant to celebrate their sensuality. This may be especially true for the mature woman, who once felt vivacious and attractive and now finds it almost impossible to fit in. A woman's body image can so detrimentally affect the way she perceives herself that it can impact her moods, her relationships, and her care and love of herself.

I have come to believe that in many cases a woman's hesitance or reluctance in approaching intimacy is not due to a lack of sexual interest, but simply because many women are self-conscious about their bodies, to the extent that they do not feel particularly alluring. Many mature women may have inhibitions caused by their self-awareness of the effects of aging. Others may feel self-conscious about weight gain, cellulite, varicose veins or scars from birthing children. Even women who would be considered objectively beautiful may believe that they can not live up to an impossible standard set by the media, and suffer from 'image inadequacy.'

I came to see this as an issue affecting the happiness of many women and of their ability to relate openly and confidently with their partners and love interests.

SUMMARY

One aspect of my invention features a body-shaping intimacy garment for a woman, the garment having an upper portion shaped or configured to support or at least contact the undersides of the breasts of a wearer while leaving the breasts exposed, a torso portion extending from the upper portion so as to encircle the torso of the wearer, a lower portion extending from the torso portion so as to contain the waist, buttocks and hips of the wearer, and two leg portions each extending from the lower portion and configured to encircle a respective leg of the wearer to at least below the knee. The lower portion defines a crotch opening through the garment, the opening sized and positioned to permit sexual intercourse. Straps extend from the upper portion so as to extend over the shoulders or about the neck of the wearer.

The torso portion, lower portion and leg portions each include respective portions of an inner layer and an outer layer. The inner layer is formed of a first stretchable fabric of dimensions selected so as to be worn stretched about the torso, waist, buttocks, hips and legs of the wearer, with tension in the straps maintaining some inner layer stretch along the torso portion while worn. The outer layer is formed of a second stretchable fabric having a lesser elasticity than the first stretchable fabric. The outer and inner layers are connected at the upper portion but are otherwise disconnected throughout front and sides of the torso and lower portions, and throughout the leg portions to at least below the knee.

The first stretchable fabric preferably has an elasticity of at least 30 percent in a direction about the wearer, and preferably also has an elasticity of at least 30 percent in a direction along the wearer. In some examples, the first stretchable fabric is a 4-way stretch fabric and has a greater elasticity about the wearer than along the wearer.

In some examples, the first stretchable fabric is a blend of about ⅔ elastomeric fibers and ⅓ rigid fibers. The rigid fibers may be nylon fibers. I am using the term 'rigid' in a technical sense; it does not mean that the rigid fibers are not flexible, but simply that they are not particularly elastic in elongation.

The second stretchable fabric preferably has an elasticity of between about 10 percent and 30 percent in a direction about the wearer, more preferably between about 10 percent and 20 percent. The second stretchable fabric preferably contains no more than about 50 percent elastomeric fiber, and in some cases has less than 25 percent elastomeric fiber.

In some preferred constructions, the first stretchable fabric is comprised primarily of elastomeric fiber, and the second stretchable fabric is comprised primarily of non-elastomeric fiber, in terms of overall fiber weight.

In some garments, the first and second stretchable fabrics are both elastane blends.

In some embodiments, at least one of the first and second stretchable fabric, if not both, is a circular knit fabric, with a machine knit direction of the fabric extending along the leg portions.

The first stretchable fabric is preferably nominally thicker and heavier, in an unstretched state, than the second stretchable fabric in an unstretched state.

In some examples the leg portions extend to about the ankles. In some other examples, the leg portions terminate just below the knee.

In some configurations, the inner and outer layers are connected along a back seam extending from the upper portion to above the crotch opening.

The garment may define a back opening extending from the upper portion at least partially down the torso portion, with a releasable fastener (e.g., a zipper) securable to close the back opening. In some other cases the garment has a non-opening back.

In some examples, the inner and outer layers are connected along the back seam only down to a point above the lower portion. In some other examples, the outer and inner layers are connected at the upper portion but are otherwise disconnected throughout the torso and lower portions.

In some garments, the outer and inner layers are disconnected throughout the leg portions. In some others, the inner and outer layers are connected at lower cuffs of the leg portions.

In some examples of the garment, the lower portion has a flap extending to selectively cover the crotch opening. The flap is larger than the crotch opening. Preferably, the crotch opening has an extent of at least three inches across, and preferably less than about six inches across. The flap, in a preferred configuration, is connected to the inner fabric layer only rearward of the crotch opening, and is not directly connected to the outer fabric layer. In some cases, the inner and outer layers are connected along a back seam extending from the upper portion to a point where the flap is connected to the inner fabric layer.

The inner and outer layers, in some examples, are each seamed in the leg portions only along an inseam and at a lower cuff.

In some garment configurations, the straps are connectable to the upper portion at multiple alternate connection points, including a point between the breasts and a point outside the breasts.

At least one accessory attachment loop may be provided on an outer surface of the outer layer on a back side of the torso portion, and accessory attachment means may be provided on the upper portion, or on the straps. The accessory attachment means may include at least one attachment loop exposed on an outer surface of the garment, for example.

In some cases, the upper portion includes an underwire positioned under each breast, such as to better support and/or shape the breast.

Preferably at least the inner layer of the garment is opaque in every region in which the garment covers skin.

Another aspect of my invention features an opaque, body-shaping base garment that supports the bust and covers the torso, hips, buttocks and thighs but that has a crotch opening to permit sexual intercourse while worn, and multiple design accessories that can be selectively worn over the base garment, as desired. Preferably, the base garment has attachment points configured to releasably attach various ones of the design accessories, which may include drapes, scarves, vests, robes, etc., that are designed to cover portions of the base garment and also, in many cases, exposed skin. The base garment is packaged separately from the accessories, many of which are packaged as coordinated accessory sets.

The garment of my invention is intended to address the feelings of image inadequacy shared by so many women when approaching or considering sexual encounters with their partners. It is intended to not only provide an image-enhancing effect leading up to intimacy and sexual intercourse, but is also configured to be left on throughout the romantic encounter, such that a woman who is self-conscious about the areas covered and smoothed by the garment need not fret in anticipation of having to remove the garment, or hide under other coverings. In this manner, my garment may prompt a liberating attitude toward intimacy among many women. The inner layer of the garment is configured to provide a body-shaping effect in the torso, hips, buttocks and upper legs, while the outer layer is configured to slide over the inner layer, and to flow over local curvature fluctuations of the inner layer, during movement while worn. While the garment may be worn on its own, in many instances it is relatively unadorned and may be accessorized with various additions to create a look suitable to the woman's romantic style and to her body shape (e.g., pear-shaped, apple-shaped, inverted triangle, etc.).

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
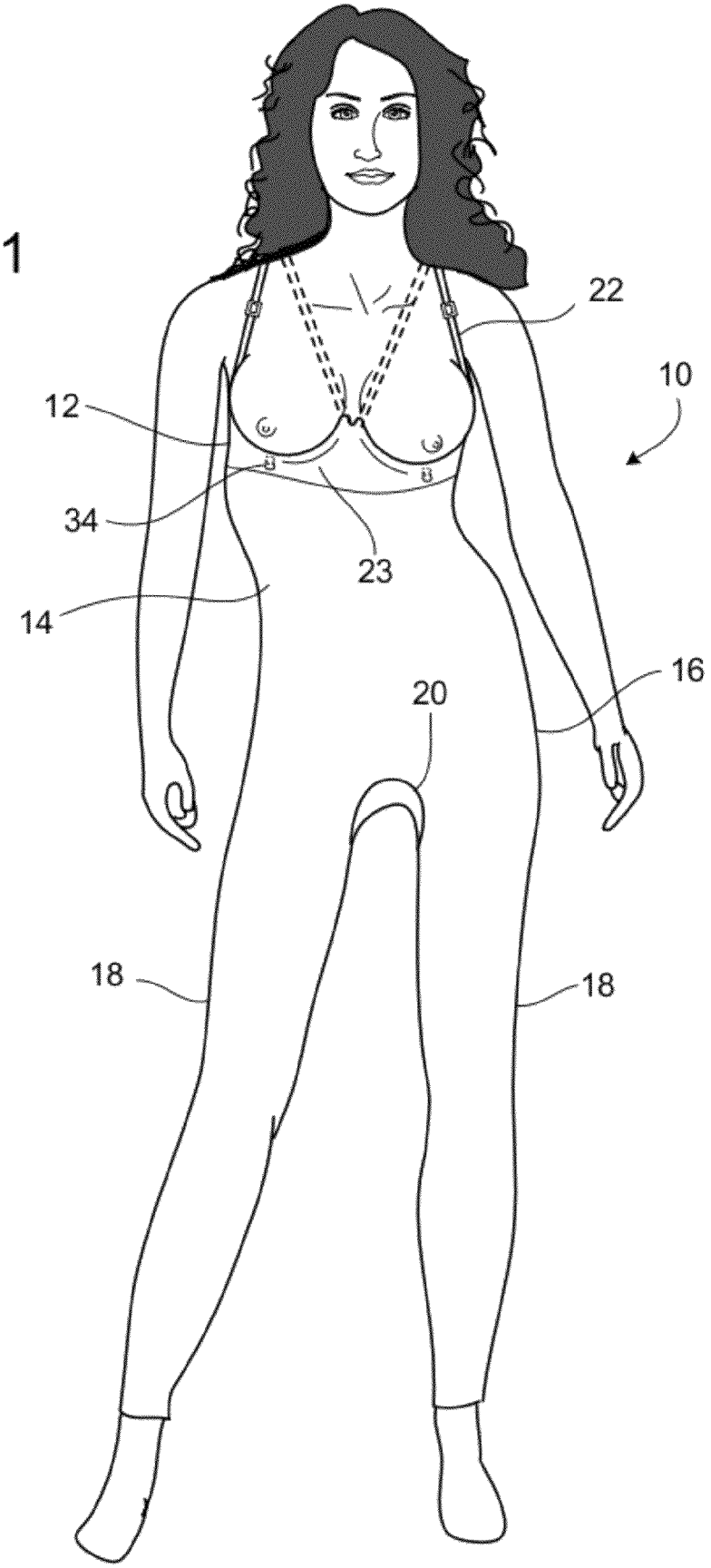
FIG. 1 is a front view of a woman wearing a body-shaping intimacy garment.

Referring first to FIG. 1, body-shaping intimacy garment 10 includes an upper portion 12, a torso portion 14 extending from the upper portion so as to encircle the torso of the wearer, a lower portion 16 extending from the torso portion so as to contain the waist, buttocks and hips of the wearer, and two leg portions 18 each extending from the lower portion and configured to encircle a respective leg of the wearer to at least below the knee. As shown, upper portion 12 is shaped to support undersides of the breasts of the wearer while leaving the breasts exposed, and the lower portion 16 defines a crotch opening 20 through the garment. Straps 22 extend from the upper portion 12 so as to extend over the shoulders or about the neck of the wearer. The straps are reconfigurable into a variety of arrangements, by selectively connecting the straps at any of a number of upper portion connecting points. The straps are shown in solid line connected to the upper portion laterally outside of the breasts, and are shown in dashed line connected to a common connection point between the breasts.

The torso portion 14, lower portion 16 and leg portions 18 are each formed by two overlapping fabric layers, including an inner layer configured to provide a body-shaping effect, and an outer layer. The two layers are substantially disconnected, such that the outer layer is able to slide over the inner layer, and to flow over local curvature fluctuations of the inner layer, during movement while worn. Both layers extend from the lower edge of upper portion 12 to cover substantially the same area and portions of the body, and have coextensive crotch openings.

In this example, leg portions 18 extend down to adjacent the ankles of the wearer. In another version (not shown), the leg portions end just below the knee. Preferably, intimacy garment 10 leaves the arms and shoulders completely exposed, except for the narrow, adjustable straps 22, which may be opaque or clear.

Figure 2:
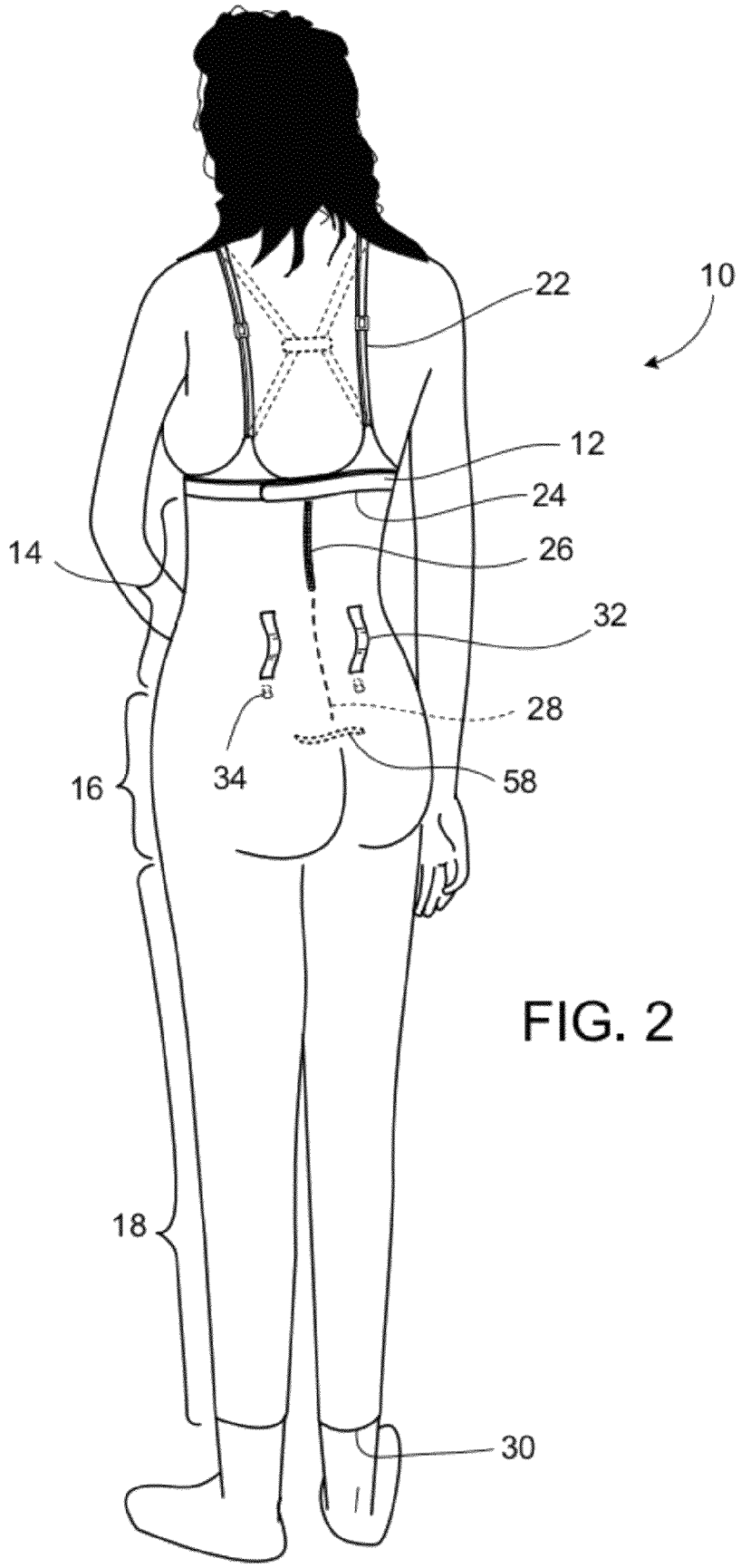
FIG. 2 is a back view of the woman wearing the body-shaping intimacy garment.

Referring also to FIG. 2, upper portion 12 in this example is essentially an underwire shelf bra that encircles the wearer and provides connections for straps 22. It may have a typical bra closure in the back or front, for use in putting the garment on or taking it off. The upper portion may be made essentially from typical bra materials and construction, and preferably is of sufficient structure to support and lift the breasts. In this example, relatively rigid wires 23 extend under each breast for support and lift. Upper portion 12 also serves to lift the inner and outer layers of the torso portion 14, which is connected to the upper portion 12 continuously about the garment along seam 24. In another example, the upper portion does not include an underwire but instead includes an elastic band that extends around the body under the breasts, and has side panels outside the breasts where strap connections are provided. In either case, the upper portion contacts undersides of the breasts, and may also provide some support and/or lift. It is preferable that a significant portion of the breasts be left exposed by the upper portion, including the area about each areola.

For some larger garment sizes, a zipper or other releasable fastener 26 is provided, to secure a back opening extending from upper portion 12 down the back of torso portion 14. In such case, the two fabric layers of the torso portion are connected along the zipper, but are otherwise detached from each other around the remainder of the back, sides and front of the torso portion. Other closure means are envisioned, such as hook-and-loop fasteners, buttons and snaps.

In many instances a back opening and closure will not be necessary, and the two fabric layers of the torso portion will be entirely disconnected everywhere below the lower edge of the upper portion.

Each of the layers forming the torso and lower portions 14, 16 is essentially a fabric tube, seamed along the back (i.e., at seam 28) from the upper portion down to crotch opening 20. Preferably, the seams of each layer overlay each other but do not connect the two fabrics together. However, in some examples the two layers are joined along rear seam 28 at least part-way down the torso portion, leaving the two layers otherwise detached from each other around the remainder of the back, sides and front of the torso and lower portions.

In leg portions 18 the two layers are completely detached from one another, at least to a point below the knees. In some cases, they are disconnected throughout the leg portions. In some cases, they are connected at the distal ends 30 of the leg portions. As discussed above, the inner fabric layer will stretch to conform to and shape the legs, while the outer layer will provide more of a covering and draping effect to conceal undesired local shape fluctuations and bulges. The outer layer may be somewhat flared, particularly below the knee, if desired.

Also shown in FIG. 2 are examples of accessory connection points, such as loops 32 or eyelets 34. Similar eyelets may be provided, for example, on straps 22 or on upper portion 12. These connection points permit the securement of various accessories over the intimacy garment, some of which are illustrated in the following figures.

Figure 3:
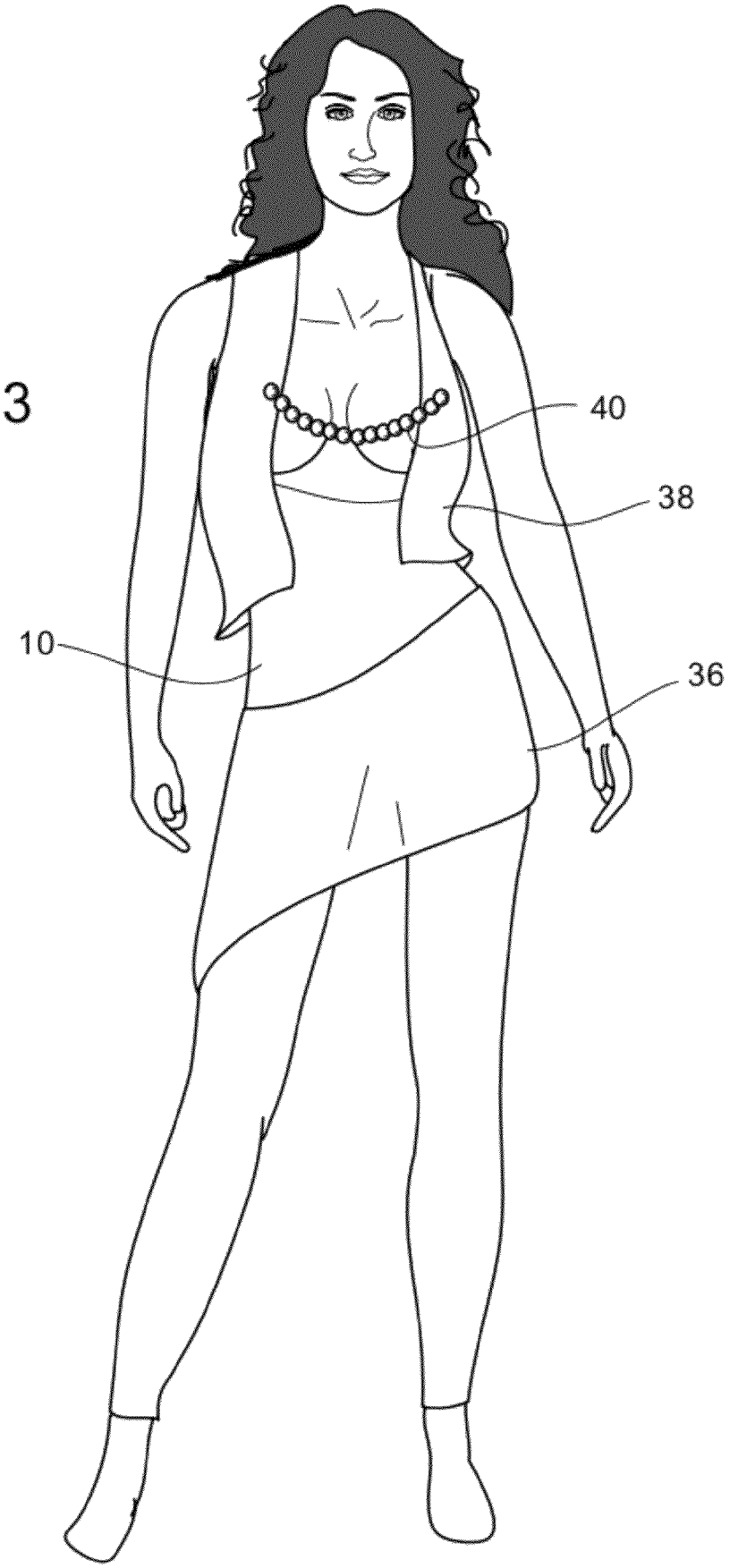
FIG. 3 is a front view of the woman wearing the body-shaping intimacy garment and a first set of accessories.

Referring next to FIG. 3, one illustrative set of intimacy garment accessories includes a waist drape 36 that is draped about the wearer to cover the crotch opening and a significant portion of the lower portion of the intimacy garment. The drape may be secured through loops in the back of the garment, or simply tied as a sash. A coordinated vest 38 drapes over the shoulders and is held together by an ornamental chain 40 to partially cover the breasts, but is not attached to the intimacy garment. This is but one example of coordinated garment accessories that may be combined with the intimacy garment in a pre-intimacy mode or even to be worn in a public or semi-private venue.

Figure 4:
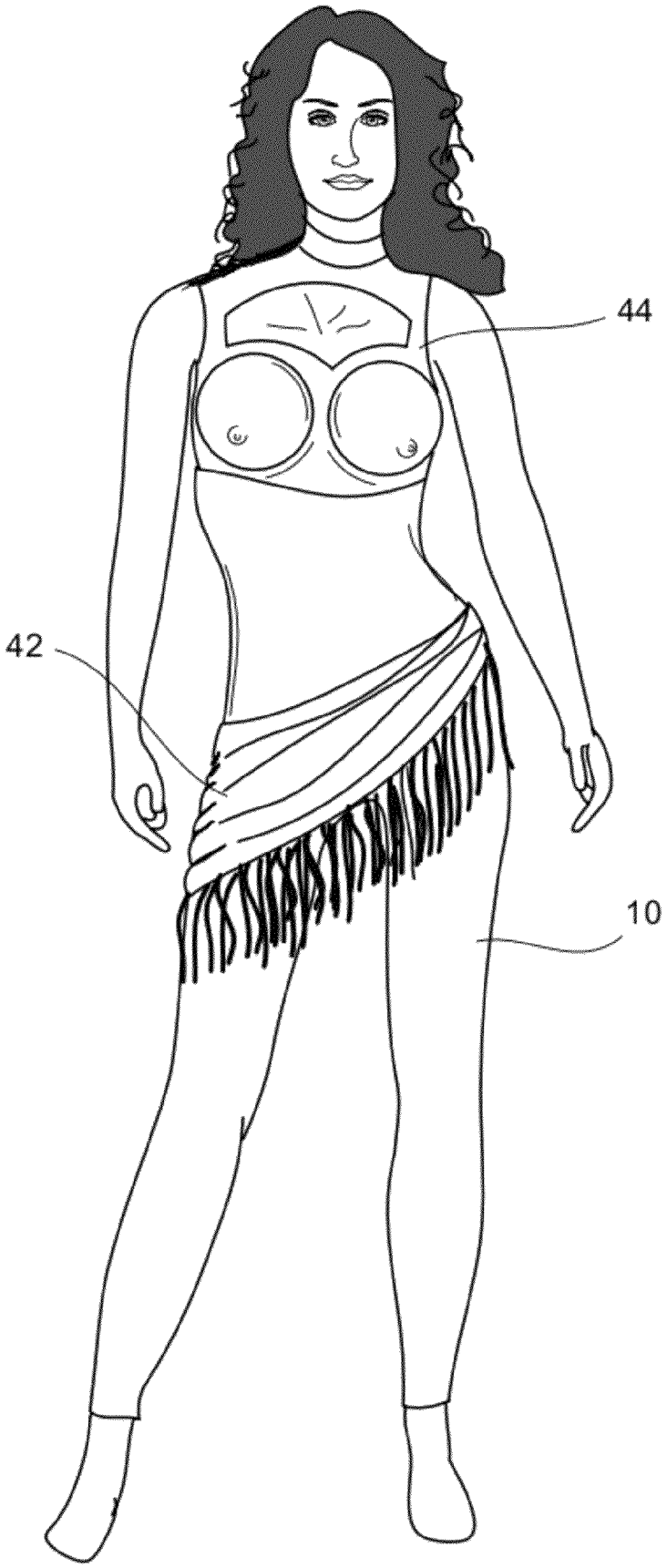
FIG. 4 is a front view of the woman wearing the body-shaping intimacy garment and a second set of accessories.

In another example, shown in FIG. 4, a fringed sash 42 covers the crotch opening and much of the lower portion of the intimacy garment, while an open mock turtleneck sleeveless accessory 44 is worn over the straps but leaving the breasts exposed. This accessory arrangement may be desired, for example, by a woman uncomfortable with the appearance of her upper chest and/or neck, or simply to enhance the overall allure of her appearance, for herself or her partner.

Figure 5:
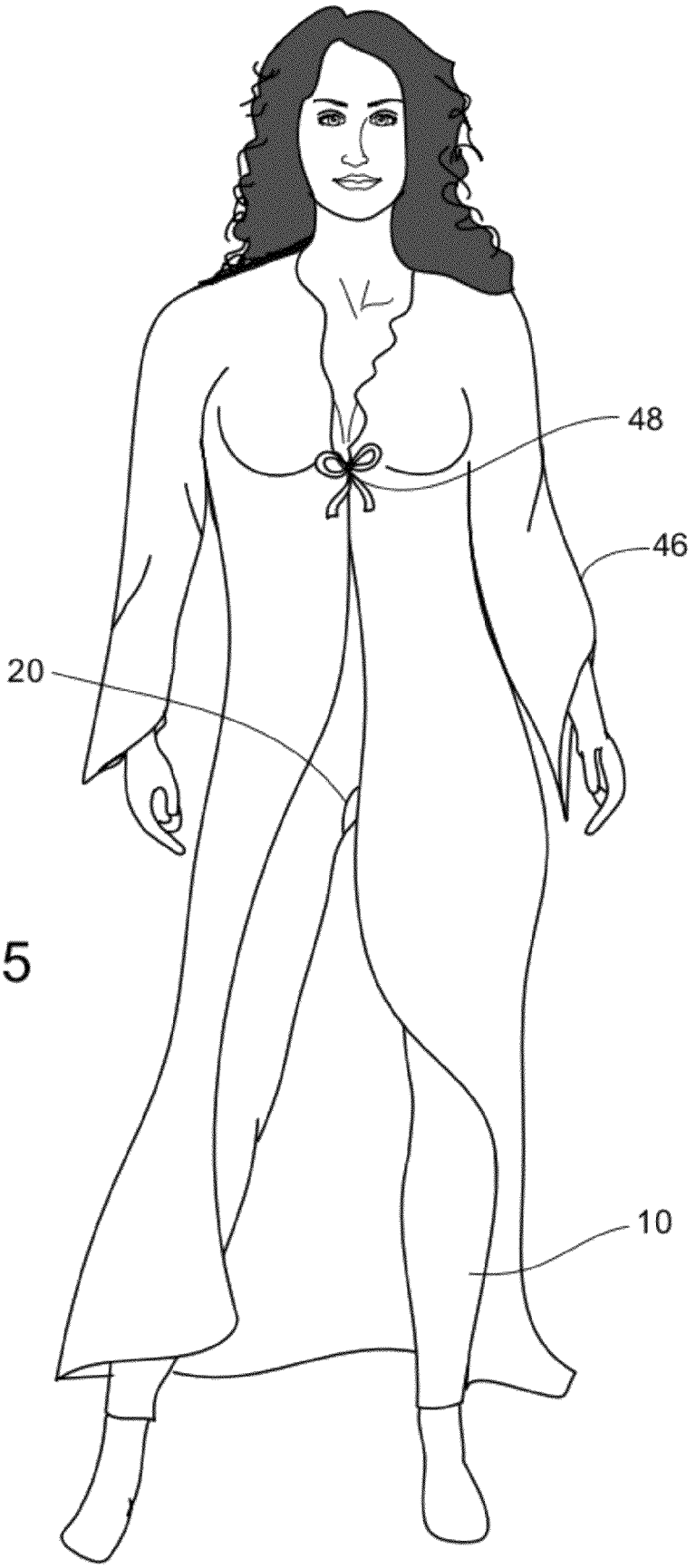
FIG. 5 is a front view of the woman wearing a gown over the body-shaping intimacy garment.

FIG. 5 illustrates the use of a free-flowing gown 46 over the intimacy garment, open at the front and releasably tied with a ribbon closure 48 at the bust. The gown covers the shoulders and arms, and may be worn over the intimacy garment around the house or in anticipation of intimacy.

Figure 6:
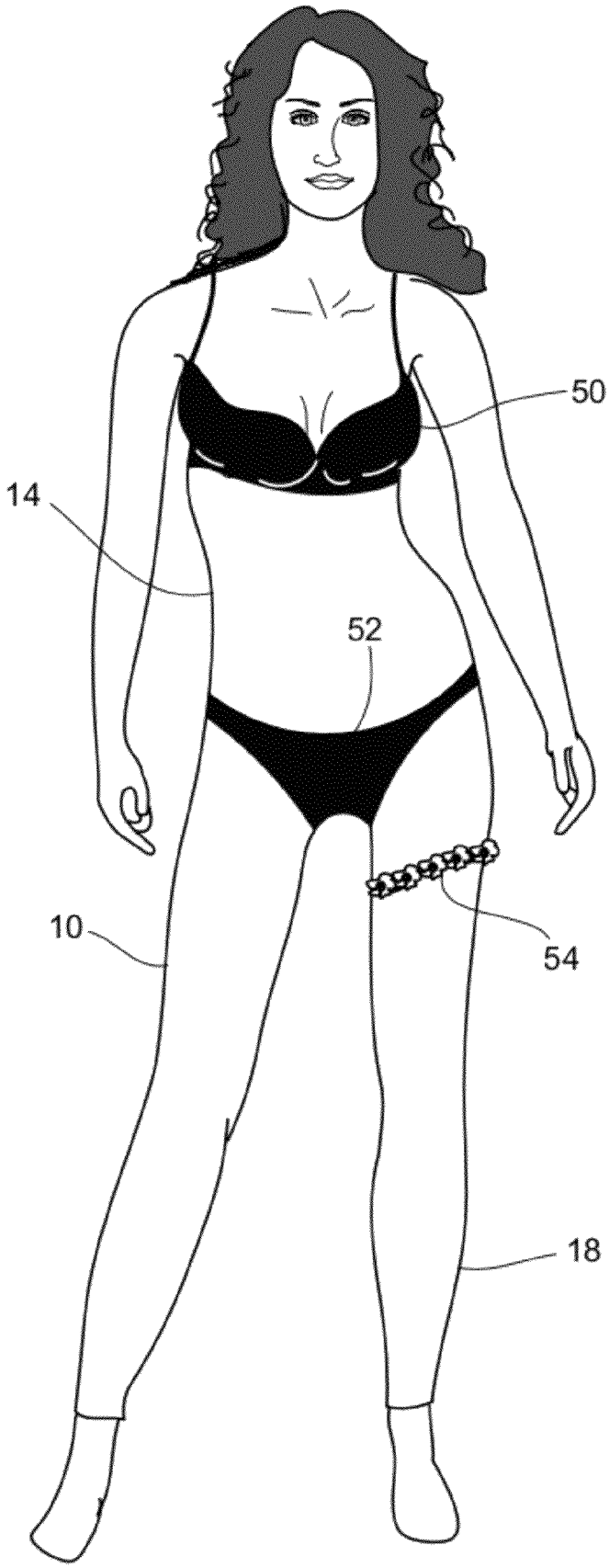
FIG. 6 is a front view of the woman wearing the body-shaping intimacy garment and a third set of accessories.

In the accessory arrangement of FIG. 6, a bikini top 50 and bottom 52 are worn over the intimacy garment, with the bikini bottom 52 covering all or part of the crotch opening and the bikini top covering the breasts. A garter belt 54 is shown over one leg. In this arrangement, all of the accessories are worn over, but do not attach to, the intimacy garment. When accessorizing with a bikini top or other bust-covering accessory with additional straps, clear straps may be preferred for the intimacy garment. During intimacy, bikini top 50 may be separately removed to expose the breasts, without affecting the intimacy garment.

Many other accessory configurations are envisioned beyond those that are illustrated here. Such accessories may be marketed as sets, for example, sold separate from the intimacy garment, for customizing the garment in different ways.

Figure 7:
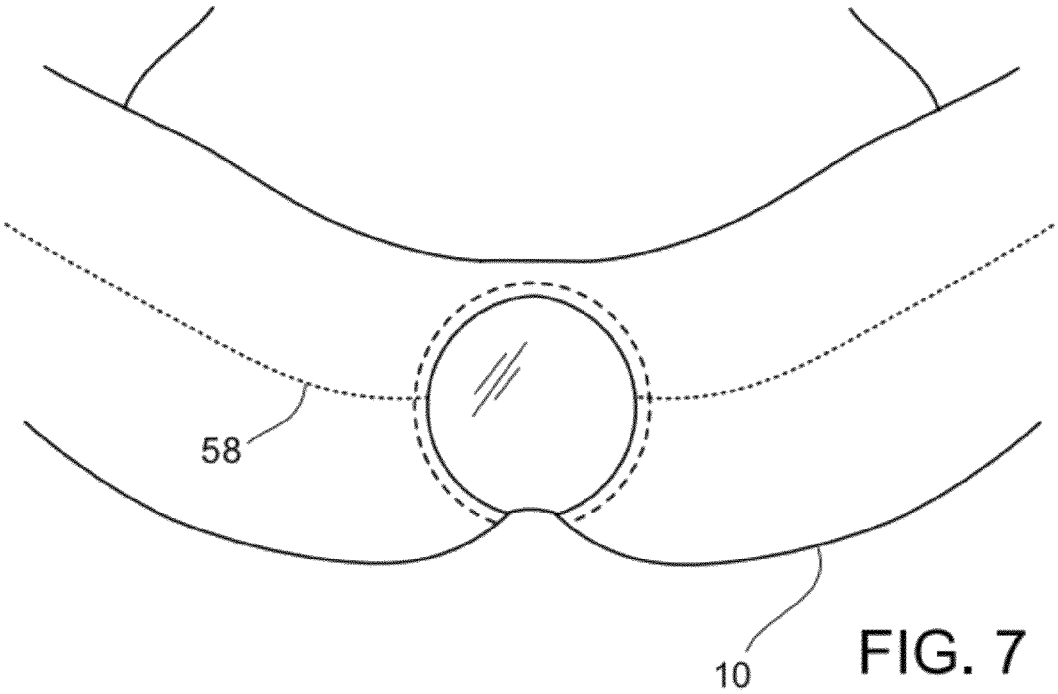
FIG. 7 shows the crotch opening of the intimacy garment covered by the flap.
Figure 8:
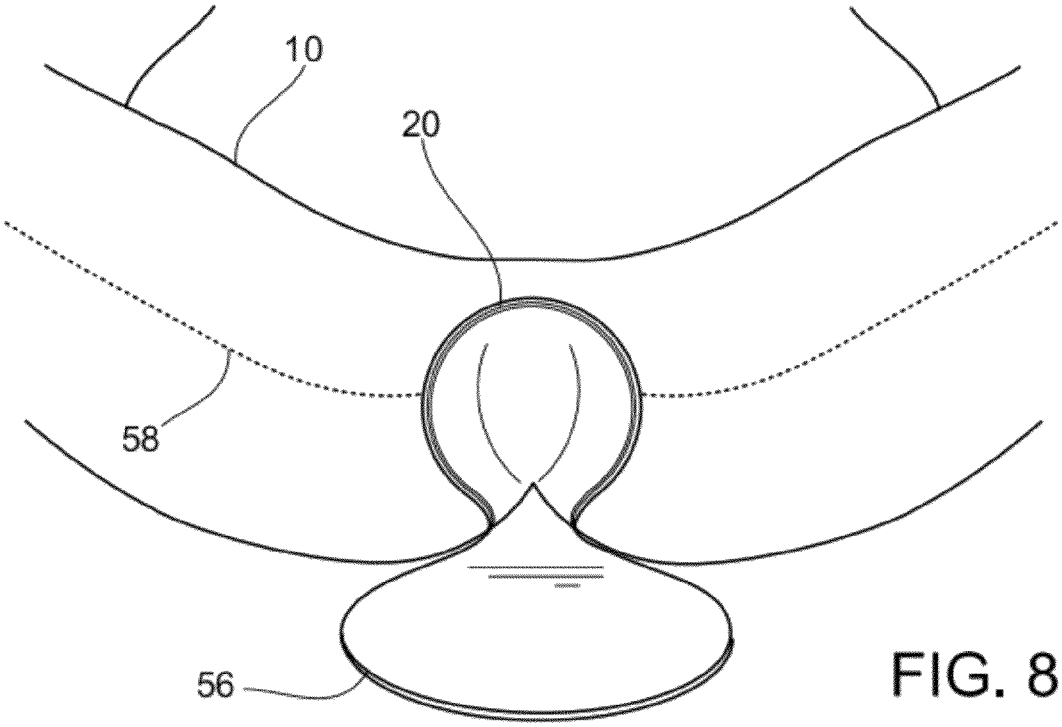
FIG. 8 shows the crotch of the intimacy garment with the flap open.

FIGS. 7 and 8 illustrate the construction and use of a crotch covering flap 56 to selectively cover and expose crotch opening 20. Flap 56 is formed of a flexible piece of fabric, preferably similar in appearance to the fabric of the outer layer of the garment, permanently secured to an outer surface of the inner layer of the garment, such as along a stitch line 58 above the buttocks (FIG. 2), but is not directly attached to the outer fabric layer of the garment (except that, in some examples, the inner and outer layers are connected along a back seam extending from the upper portion to the point where the flap is connected to the inner fabric layer). Thus, flap 56 is positioned between the two fabric layers. In some cases, the flap is formed as two flap layers stitched together, such as of the same materials as those used for the inner and outer garment layers. When the garment is initially donned, the wearer positions the edges of the flap between the two fabric layers about the crotch opening, and friction between the flap and the layers holds the flap in place covering the crotch opening during typical movement. During intimacy, the flap is readily pulled out from between the fabric layers to expose the vaginal opening. The flap and the fabric layers about the crotch opening are preferably free of fasteners or rigid material that may cause discomfort to the wearer or her partner. The edges of each of the fabric layers may be serged or bordered at the crotch opening, and the flap edge may be serged or bordered, but care should be taken not to significantly stiffen the fabric in this area. The crotch opening is sized and positioned to permit sexual intercourse, by exposing the wearer's vaginal area with legs opened. The crotch opening preferably has an extent, in both lateral and fore-aft directions, of at least about 7.5 centimeters, and preferably less than about 15 centimeters, and the flap is larger than the opening. Thus, by 'opening' I do not mean a fly or a slit defined by abutting fabric edges that may be useful for urination but not provide an unobstructed opening for sexual intercourse.

FIGS. 7 and 8 also illustrate the seaming of the leg portions of the garment. In this example, each fabric layer essentially forms a tube about each leg, with a single seam 58 running along the inseam from the crotch opening to the lower end or cuff of the leg portion. As discussed above, the inner and outer layers of each leg portion are not secured to each other along the leg, other than optionally at the lower end or cuff of the leg. Neither are the inner and outer layers connected to each other about the crotch opening.

Figure 9:
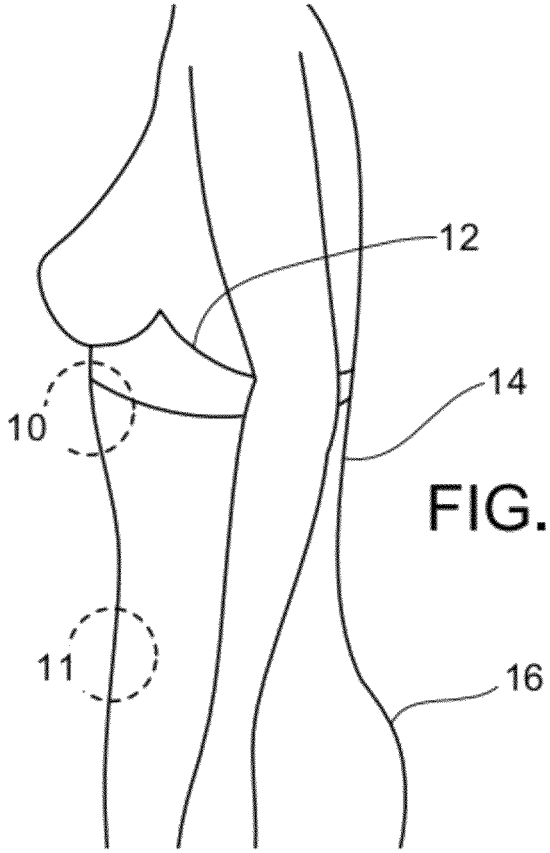
FIG. 9 is a side view of the woman wearing the body-shaping intimacy garment.
Figure 10:
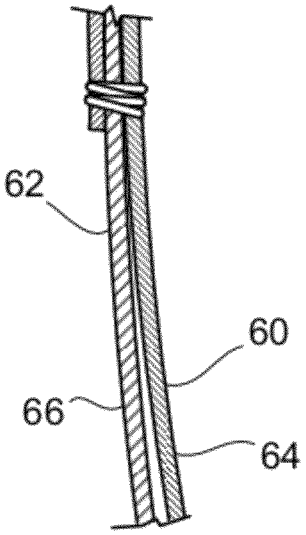
FIGS. 10 and 11 are partial cross-sectional views, taken in areas 10 and 11 of FIG. 9.
Figure 11:
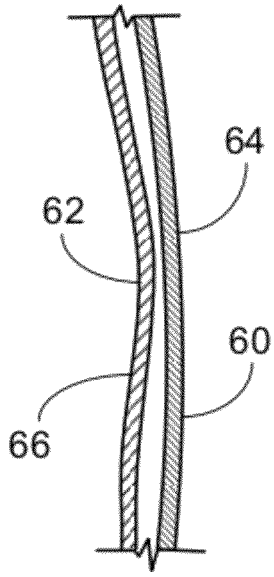

Referring next to FIGS. 9-11, the torso, lower and leg portions of the garment are formed of respective portions of an inner layer 60 and an outer layer 62. The inner layer is formed of a first stretchable fabric 64 of dimensions selected so as to be worn stretched about the torso, waist, buttocks, hips and legs of the wearer, with tension in the straps 22 (see FIG. 1) maintaining some inner layer stretch along the torso portion while worn, such that the inner portion is configured to provide a body-shaping effect. Outer layer 62 is formed of a second stretchable fabric 66 having a lesser elasticity than the first stretchable fabric. Both fabrics 62, 64 are preferably elastane blends, in that they contain both elastane (Spandex) or other elastomeric fibers and rigid (i.e., non-elastomeric) fibers, such as nylon or polyester. Of course, the term 'elastomeric' should be understood to encompass elastane and other materials with substantial elastic resiliency, similar to that of Spandex, preferably with at least about 300 percent fiber elongation to break.

The fabric 64 of inner layer 60 is preferably a heavy, high-stretch blend, of the type of properties generally associated with terms like "power spandex" or "jumbo spandex." The inner layer should be cut so that the fabric is maintained in a significantly stretched condition, both about the wearer and along the wearer, during use, so as to perform a body-shaping function to the torso, buttocks, hips and thighs. The inner fabric layer should have an elasticity of at least 30 percent in a direction about the wearer, and at least 30 percent in a direction along the wearer, as oriented in the garment. Ideally, the inner layer fabric has a greater elasticity about the wearer than along the wearer. The inner fabric layer is preferably a blend of about ⅔ elastomeric, ⅓ rigid (e.g., nylon) fibers. One preferred material for the inner layer is a circular knit, 4-way stretch fabric with a basis weight of about 11 ounces per square yard (osy; 370 gsm), presently available as "JUMBO Spandex" from Spandex House in New York City, N.Y. This particular material is 66 percent 70 denier spandex fiber, 24 percent 40 denier bright nylon fiber, and 10 percent 280 denier semi-dull nylon fiber. The inner layer is formed with the machine direction of the circular knit extending up and down along the wearer, and the garment is sized such that, when worn, some vertical tension is maintained in at least the torso portion of the inner layer of the garment by the garment straps.

The outer layer fabric 66 is also a stretch knit material, but is of substantially less elasticity than the inner layer, and is cut so as to flow over localized fluctuations of the inner layer in use, but still to follow the more general contour of the body. One presently preferred outer layer material is a 4-way stretch Milliskin Tricot comprised of 80 percent spandex and 20 percent nylon, with a basis weight of about 5.8 osy (200 gsm), also available from Spandex House in NYC. Another suitable outer layer fabric is a blend of about 90 percent polyester, 10 percent spandex, and yet another is a blend of about 87 percent nylon and 13 percent spandex. In some versions, the outer layer is a stretch fine mesh material with lace features, or a stretch lace material. The outer layer is preferably sized such that some stretch is induced during wear to avoid puckering and wrinkling, but not as much as is induced in the inner fabric layer. The optimal difference in cut size between the inner and outer layers will depend, in part, on the shape and size of the garment and the particular stretch characteristics of each layer. Because the outer layer is substantially detached from the inner layer, it 'floats' over the inner layer, maintaining a relatively smooth topography. Thus, the outer layer is configured to slide over the inner layer, and to flow over local curvature fluctuations of the inner layer, during movement while worn.

The inner layer may be constructed so as to provide significant body shaping without detracting from the pleasing appearance of the garment when worn, due in part to the presence of the outer layer, which can effectively hide the localized bulging or creasing that can tend to occur in an inner layer configured to constrain the body sufficiently for shaping. The outer layer may also provide a more pleasing aesthetic appearance due to the selection of an outer layer fabric with a desired finish and sheen. In general, the outer layer should be sized to be somewhat form-fitting over the inner layer, but not so as to be stretched as much as the inner layer in use.

The outer fabric layer is also preferably thinner and lighter than the inner fabric layer in an unstretched state, and can be selected to provide an aesthetically pleasing outer surface finish and color. Suitable fabrics are available in circular knit construction in both shiny and matte finishes. The outer layer fabric 66 preferably has an elasticity of between about 10 percent and 30 percent (in some cases, between about 10 and 20 percent) in a direction about the wearer, and contains no more than 50 percent (preferably less than 25 percent) elastane or other elastomeric fiber. Like the inner layer fabric, in a preferred example the outer layer fabric is a circular knit oriented with the machine knit direction of the fabric extending down the torso and lower portions and along the leg portions.

Stretch properties of fabrics, as discussed herein, are determined in accordance with ASTM 6614-00 Standard Test Method for Stretch Properties of Textile Fabrics—CRE Method.

Referring back to FIG. 1, in the illustrated example of the intimacy garment each of the inner and outer layers consists of a single, continuous piece of fabric that extends from the bottom of the upper portion 12 to the bottoms of the leg portions 18, forming the torso, lower and leg portions of the garment. Preferably, at least one of the layers is opaque. In another example (not shown), the outer layer is fashioned of one piece of material that forms the torso and lower portions and upper parts of the leg portions, and a different stretch material, such as a stretch fishnet, that forms the lower part of the leg portions, perhaps down to the ankle. In another example, the outer layer is fashioned out of multiple stretch materials, such as a stretch lace or stretch satin or stretch pleather, combined with one of the materials discussed above, pieced together to cover different areas, or in some cases overlaying each other. In some cases, the inner layer is of a nude color material and the outer layer is of a fine mesh material of a different color, to simulate the appearance of skin barely visible under the outer material. In some cases the outer material extends farther down the legs than the inner material. Preferably, neither layer includes any welts or bands of material that form a visual discontinuity to detract from the visual attractiveness and fluidity of the outer fabric layer. Many other combinations of outer and inner materials and features are envisioned, within the general concept of the invention.

While a number of examples have been described for illustration purposes, the foregoing description is not intended to limit the scope of the invention, which is defined by the scope of the appended claims. There are and will be other examples and modifications within the scope of the following claims.

What is claimed is:

1. A body-shaping intimacy garment for a woman, the garment comprising:

an upper portion configured to contact undersides of the breasts of a wearer while leaving the breasts exposed;

a torso portion extending from the upper portion so as to encircle the torso of the wearer;

a lower portion extending from the torso portion so as to contain the waist, buttocks and hips of the wearer;

two leg portions each extending from the lower portion and configured to encircle a respective leg of the wearer to at least below the knee; and straps extending from the upper portion so as to extend over the shoulders or about the neck of the wearer;

wherein the lower portion defines a crotch opening through the garment, the crotch opening sized and positioned to permit sexual intercourse;

wherein the torso portion, lower portion and leg portions each comprise respective portions of:

an inner layer formed of a first stretchable fabric of dimensions selected so as to be worn stretched about the torso, waist, buttocks, hips and legs of the wearer, with tension in the straps maintaining some inner layer stretch along the torso portion while worn; and an outer layer formed of a second stretchable fabric having a lesser elasticity than the first stretchable fabric; and wherein the outer and inner layers are connected at the upper portion but are otherwise disconnected throughout front and sides of the torso and lower portions, and throughout the leg portions to at least below the knee.

2. The body-shaping intimacy garment of claim 1, wherein the first stretchable fabric has an elasticity of at least 30 percent in a direction about the wearer.

3. The body-shaping intimacy garment of claim 1, wherein the first stretchable fabric is a 4-way stretch fabric and has a greater elasticity about the wearer than along the wearer.

4. The body-shaping intimacy garment of claim 1, wherein the second stretchable fabric has an elasticity of between about 10 percent and 30 percent in a direction about the wearer.

5. The body-shaping intimacy garment of claim 1, wherein the first and second stretchable fabrics are elastane blends.

6. The body-shaping intimacy garment of claim 1, wherein the first stretchable fabric is comprised primarily of elastomeric fiber, and the second stretchable fabric is comprised primarily of non-elastomeric fiber.

7. The body-shaping intimacy garment of claim 1, wherein the first stretchable fabric is a circular knit fabric, with a machine knit direction of the fabric extending along the leg portions.

8. The body-shaping intimacy garment of claim 1, wherein the first stretchable fabric is nominally thicker and heavier, in an unstretched state, than the second stretchable fabric in an unstretched state.

9. The body-shaping intimacy garment of claim 1, wherein the leg portions extend to about the ankles.

10. The body-shaping intimacy garment of claim 1, wherein the inner and outer layers are connected along a back seam extending from the upper portion to above the crotch opening.

11. The body-shaping intimacy garment of claim 1, wherein the garment defines a back opening extending from the upper portion at least partially down the torso portion, the garment further comprising a releasable fastener securable to close the back opening.

12. The body-shaping intimacy garment of claim 1, wherein the inner and outer layers are connected along the back seam only down to a point above the lower portion.

13. The body-shaping intimacy garment of claim 1, wherein the outer and inner layers are connected at the upper portion but are otherwise disconnected throughout the torso and lower portions.

14. The body-shaping intimacy garment of claim 1, wherein the outer and inner layers are disconnected throughout the leg portions.

15. The body-shaping intimacy garment of claim 1, wherein the lower portion of the garment comprises a flap extending to selectively cover the crotch opening, the flap being larger than the crotch opening.

16. The body-shaping intimacy garment of claim 15, wherein the crotch opening has an extent of between about three and six inches across.

17. The body-shaping intimacy garment of claim 15, wherein the flap is connected to the inner fabric layer only rearward of the crotch opening, and is not directly connected to the outer fabric layer.

18. The body-shaping intimacy garment of claim 15, wherein the inner and outer layers are connected along a back seam extending from the upper portion to a point where the flap is connected to the inner fabric layer.

19. The body-shaping intimacy garment of claim 1, wherein the straps are connectable to the upper portion at multiple alternate connection points, including a point between the breasts and a point outside the breasts.

20. The body-shaping intimacy garment of claim 1, further comprising at least one accessory attachment loop on an outer surface of the outer layer on a back side of the torso portion.

* * * * *